US005335912A

United States Patent [19]

Brooks

[11] Patent Number: 5,335,912

[45] Date of Patent: Aug. 9, 1994

[54] DEVICE FOR GENERATING RANDOM NUMBERS OF DIFFERING LENGTHS

[76] Inventor: Dewey L. Brooks, 12001 Belcher Rd. #E70, Largo, Fla. 34643

[21] Appl. No.: 117,385

[22] Filed: Sep. 3, 1993

[51] Int. Cl.[5] ..... A63F 7/04; A63F 3/06

[52] U.S. Cl. ..... 273/144 B

[58] Field of Search ..... 273/144 B, 144 R, 145 C, 273/145 CA

[56] References Cited

U.S. PATENT DOCUMENTS 4,530,503 7/1985 Rice ..... 273/144 B

FOREIGN PATENT DOCUMENTS 3329359 2/1985 Fed. Rep. of Germany ... 273/144 B
3603302 8/1987 Fed. Rep. of Germany ... 273/144 B
2431158 3/1980 France ..... 273/144 B

*Primary Examiner*—Benjamin H. Layno
*Attorney, Agent, or Firm*—Joseph C. Mason, Jr.; Ronald E. Smith

[57] ABSTRACT

A random number generator for generating lottery numbers includes a bottle that contains a large number of balls. Each ball has a different number imprinted on it. The balls are loosely packed within the bottle so that shaking or inverting the bottle scrambles the balls. In all embodiments, a cylindrical, ball-receiving neck extension member receives one or more numbered balls when the bottle is inverted. In a first embodiment, a flexible and resilient boot conforms to the shape of the bottle and the neck of the bottle throughout all positions of the boot. The uppermost end of the boot remains in a cylindrical, ball-receiving configuration at all times. In a second embodiment, multiple cylindrical ball-receiving parts of differing lengths are separately attached to the open bottle neck, and in a third embodiment, a rigid boot includes a lower part that slidably engages the lower part of the bottle and an upper part that slidably engages the neck of the bottle. The ball-retaining capacity of the upper part of the boot depends upon the position of the lower part of the boot.

2 Claims, 3 Drawing Sheets

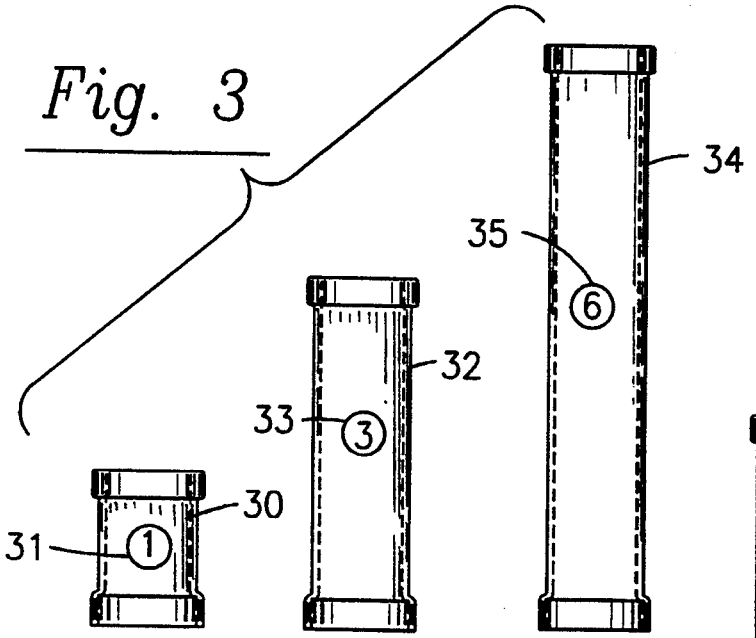
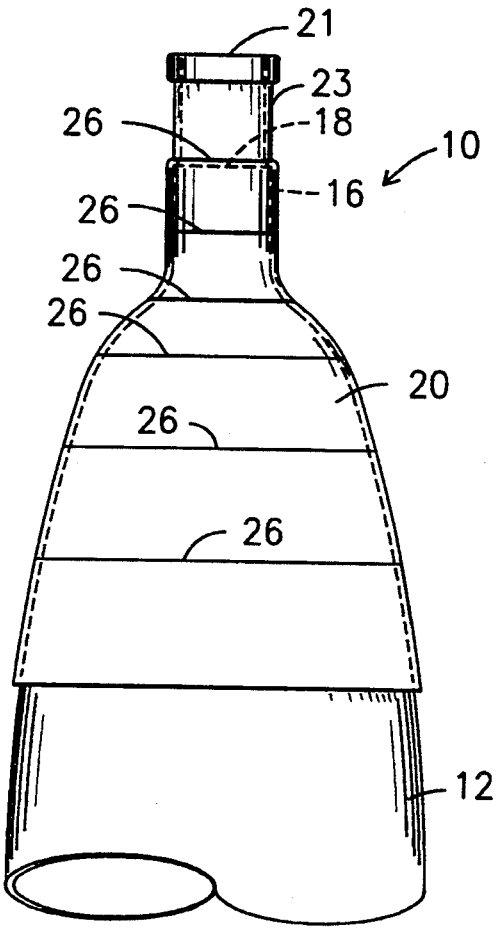
Fig. 1
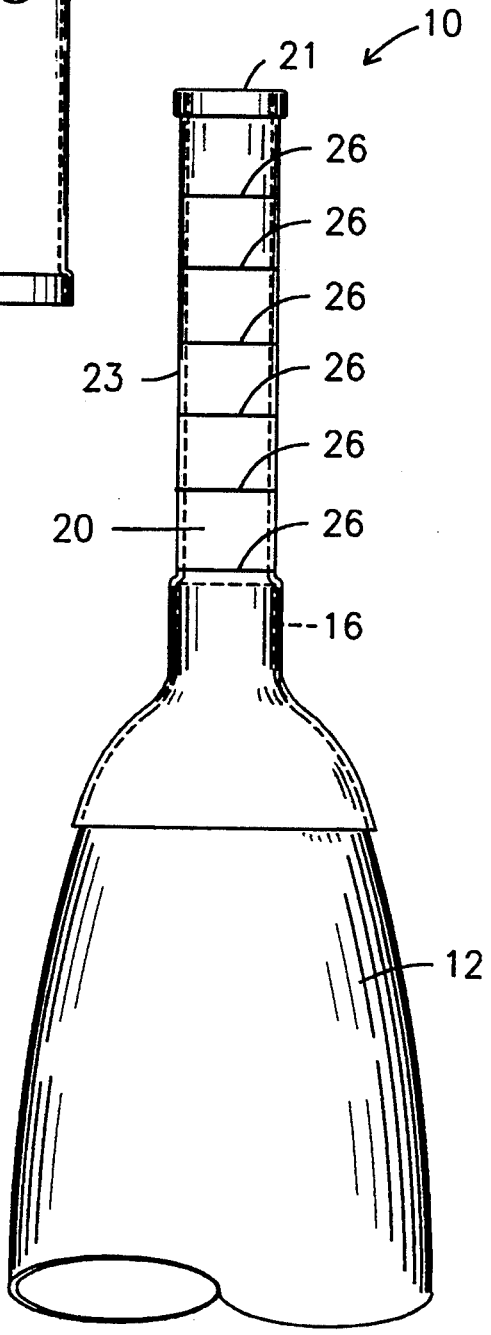
Fig. 2

DEVICE FOR GENERATING RANDOM NUMBERS OF DIFFERING LENGTHS

BACKGROUND OF THE INVENTION

1. Field of the Invention

This invention relates, generally, to random number generators. More particularly, it relates to a random number generator that can generate a single random number or multiple random numbers.

2. Description of the Prior Art

Many people derive pleasure from playing state-sponsored lottery games, and other games involving the selection of random numbers. Choosing the numbers to play in the games is part of the fun, but players eventually grow tired of playing the same numbers based on birthdays, wedding anniversaries, and the like. Some players like to choose random numbers by throwing darts at dart boards having numbers thereon, and so on.

Examples of non-dart board devices for generating random numbers are shown in U.S. Pat. Nos. 4,796,890, 5,114,146, 5,039,101, and 4,874,178.

Of all the foregoing patents, the '178 patent is of most interest because it shows a bottle filled with a plurality of numbered balls and a neck into which six balls may randomly enter when the bottle is shook and inverted. Thus, where a player desires to select six random numbers, the bottle is shaken to stir the balls and inverted; the numbers on the balls that fall into the neck are then selected as the numbers to be played. However, many states play games where only three numbers are selected, where five numbers are selected, and so on. Thus, a player using the '178 device will have to ignore some of the balls in the neck at the time the numbers are selected, and no method is provided to direct the player as to which numbers should be ignored. Thus, the player does not feel that the numbers were truly randomly generated because he or she must make the final selection.

The '178 patent document recites that for games involving differing numbers of random numbers, the neck of the bottle would need to be longer or shorter. Thus, if a player wanted to select three numbers for a game, a bottle having a neck with a length equivalent to the collective diameter of three balls would have to be purchased, and so on. Thus, a player would need to own a plurality of the '178 devices, and all of said devices would have to be filled with numbered balls.

Thus, there is a need for a device that could provide differing quantities of random numbers so that multiple devices would not need to be purchased, but the prior art, when considered as a whole, neither teaches nor suggests to those of ordinary skill in this art how the needed device could be provided.

SUMMARY OF THE INVENTION

The longstanding but heretofore unfulfilled need for a random number generator having the versatility to select a broad range of random numbers from one (1) to six (6) or more is now fulfilled in the form of a device having, in a first embodiment, a conventional bottle fitted with an adjustable length neck extension member. In a second embodiment, a conventional bottle is fitted with a plurality of detachable necks of differing lengths, and in a third embodiment, a long-necked bottle is fitted with a fixed length neck extension means.

The use of any of the three embodiments as a random number generator removes the need for the player to make any decisions as to what numbers should be selected. When a game calling for the selection of three random numbers is to be played, for example, a player using the first or third embodiment may adjust the effective length of the neck of a bottle to accommodate three balls. A player using the second embodiment would detach the neck used in a previous game and attach the neck having a three ball capacity. Thus, in any embodiment, it is a simple matter to reconfigure a bottle so that it generates differing quantities of random numbers.

It is therefore understood that the primary object of this invention is to advance the art of random number generators by providing a bottle having either a neck extension means of adjustable length or a plurality of detachable necks of differing lengths so that lottery games calling for selection of differing amounts of random numbers may be played without requiring the player to make any specific selection of numbers.

Another object is to provide a random number generator of elegant yet inexpensive design so that it will be easily affordable by consumers.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 1 is an elevational view of a first embodiment of the invention in a first configuration;

FIG. 2 is an elevational view of said first embodiment in a second configuration;

FIG. 3 is a collective view of the differing neck pieces of the second embodiment;

DETAILED DESCRIPTION OF THE PREFERRED EMBODIMENT

Figure 4:
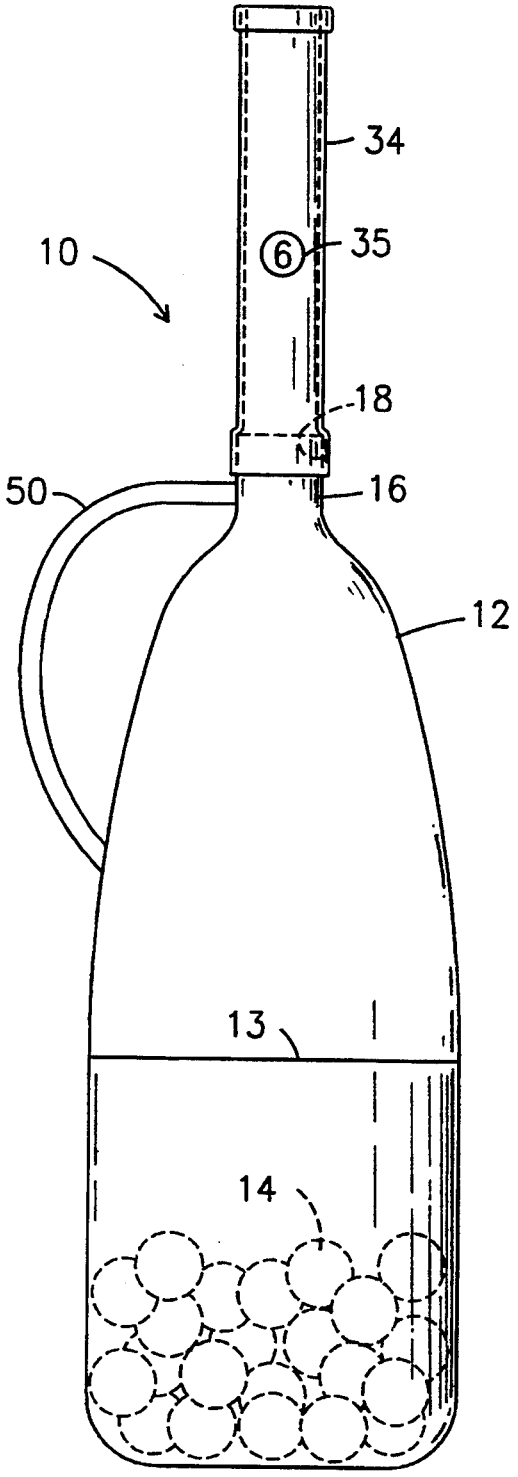
FIG. 4 is an elevational view of a second embodiment in an upright configuration.

Referring now to FIG. 1, it will there be seen that a first illustrative embodiment of the invention is denoted as a whole by the reference numeral 10. Random number generator 10 includes a bottle 12 having a plurality of numbered balls, collectively denoted 14 (see FIGS. 4–7), disposed loosely therewithin so that shaking or inverting the bottle results in random scrambling of said balls and hence of the numbers imprinted thereon. Bottle 12 has a main body and a neck or spout 16 of conventional length formed integrally therewith that terminates in an opening 18 having a diameter slightly larger than the common respective diameters of said balls so that the balls may exit said spout when the bottle is inverted.

A movably mounted boot 20 that performs the function of a neck extension means is formed of a flexible and resilient material and has a cylindrical configuration when in repose. As shown in FIGS. 1 and 2, the diameter of boot 20 in repose is substantially equal to the diameter of neck 16. Note that top end 21 of the boot is closed. The part of boot 20 that contacts bottle 12 and spout 16 conforms to the contour of said bottle and spout at all times, i.e., it conforms to said contour when the novel apparatus is in the configuration of FIG. 1, FIG. 2, and all configurations therebetween. The cylindrical, neck-extension part 23 of boot 20 has a diameter sufficient to receive therewithin said balls when said neck-extension part 23 is in repose. It should be apparent that when the boot is in its lowermost position, as in FIG. 1, only one ball may enter thereinto, and that when said boot is in its uppermost position, as shown in FIG. 2, six balls may enter thereinto. Other embodiments that are clearly within the scope of this invention would include an elongated boot capable of holding a dozen or even more balls. Significantly, when the boot is extended to its maximum ball-receiving capacity, the boot still conforms to the contour of the bottle 12 and spout 16 due to its elasticity and resiliency.

Graduations 26 may also be provided along the extent of ball-receiving upper part 23 to facilitate proper positioning of the boot.

Figure 5:
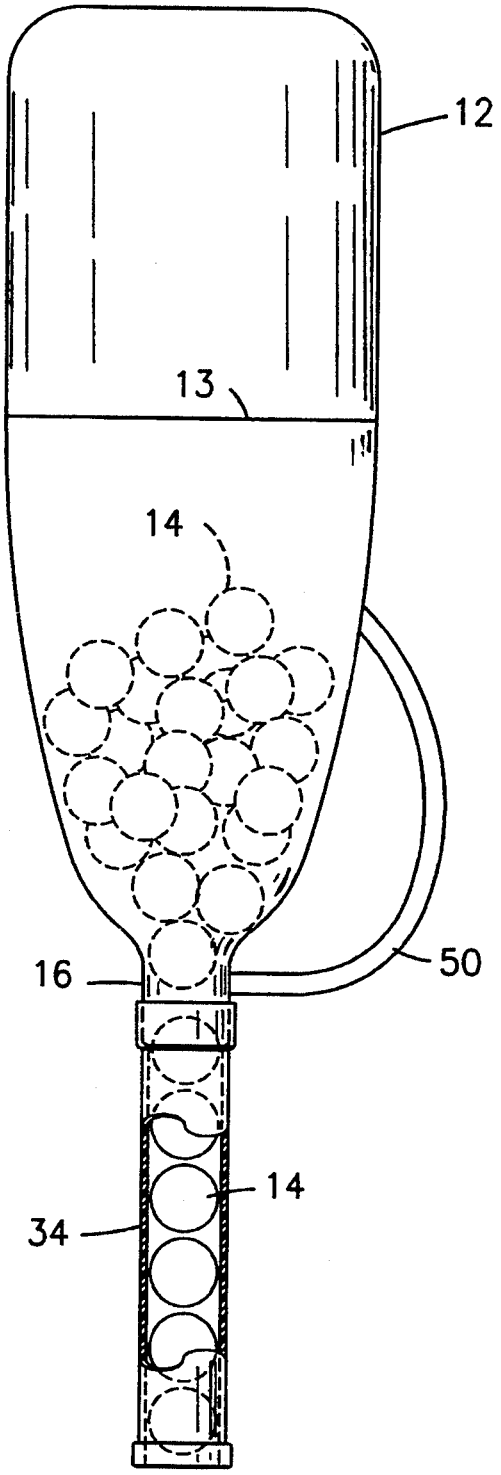
FIG. 5 is an elevational view of said second embodiment in an inverted configuration.

The second embodiment is depicted in FIGS. 3–5. FIG. 3 shows a plurality of extension members 30, 32, and 34 that are interchangeably and detachably connectable to spout 16 of bottle 12; these extension members have a one, three, and six ball capacity, respectively, as indicated by the indicia 31, 33, and 35 imprinted thereon. Thus, where a player desires to select a series of random numbers one at a time, the smallest attachment 30 is press fit onto the spout of bottle 12. FIG. 4 shows an attachment of a six-ball-capacity attachment member 34. It should be understood that unillustrated attachment members having differing ball-receiving capacities are within the scope of this invention. Any suitable attachment means may be employed, but the preferred attachment, as depicted, is a press fit between the lowermost end of each attachment member and the uppermost end of spout 16.

Figure 6:
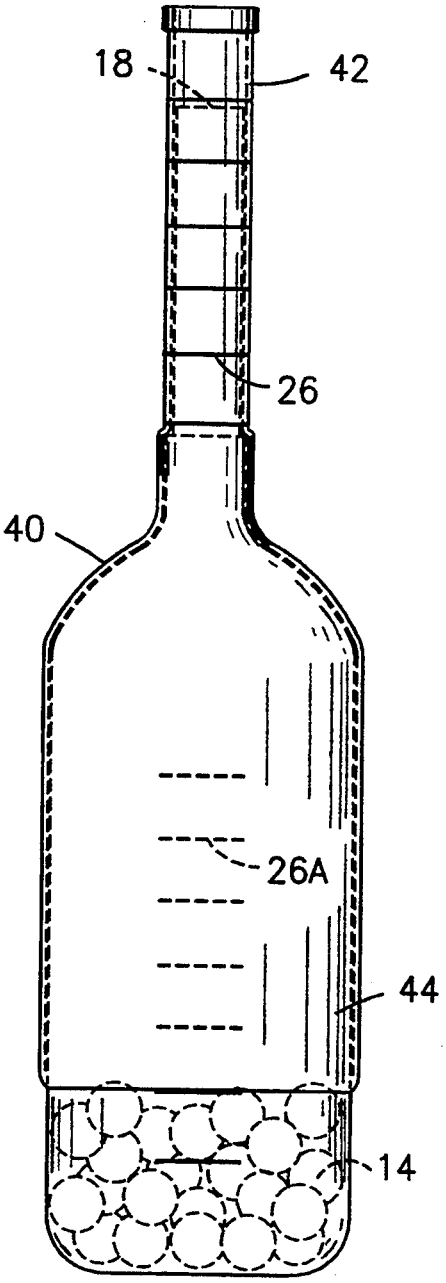
FIG. 6 is an elevational view of a third embodiment in a first configuration.
Figure 7:
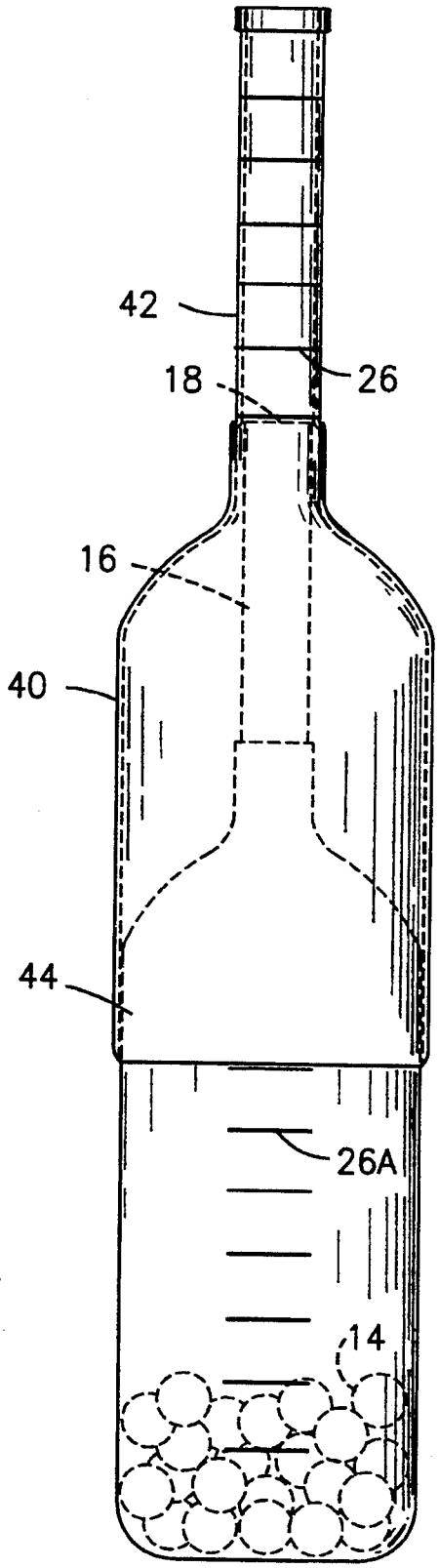
FIG. 7 is an elevational view of said third embodiment in a second configuration.

The third illustrative embodiment is depicted in FIGS. 6 and 7. In this embodiment, a rigid boot 40 having an elongate, ball-receiving neck 42 has a lowermost end 44 that grips bottle 12. When the boot is in its lowermost position relative to said bottle, as depicted in FIG. 6, only one ball 14 may enter neck 42 when the bottle is inverted. When the boot is in its uppermost position, as depicted in FIG. 7, six balls 14 may enter thereinto upon inversion. Graduations 26 are also provided in this embodiment to facilitate setting the boot at its proper position for games involving the random selection of one to six numbers. Moreover, embodiments where the length of neck 42 is extended to handle more than six balls are also within the scope of this invention.

All three embodiments provide new ways for lottery players to select random numbers in a truly random fashion that requires no decision-making on the part of the player. In all three embodiments, the bottle 12 may be a conventional two liter bottle of the type in which soft drinks are sold. A handle 50 (FIGS. 4 and 5) may be added to the bottle if desired to facilitate its shaking and inversion. Where no handle is desired, a consumer may simply use an empty two liter bottle to perform the ball-retaining function. Thus, only the boot 20 of the first embodiment need be purchased by those who prefer that embodiment. For those who prefer the second embodiment, only the attachment members 30, 32, 34, and other attachment members of differing ball-receiving capacities need be purchased. Similarly, only boot 40 need be purchased for consumers desiring to use the third embodiment. In all cases, the consumers may provided their own numbered balls as well. However, it is contemplated that most consumers will prefer to purchase complete packages, including a bottle having fifty or more (depending upon the state) numbered balls therewithin, for each embodiment selected.

In all embodiments, the bottle may be built in two parts to facilitate the charging of balls thereinto. The two parts of bottle 12 meet along parting line 13 (see FIGS. 4 and 5). The interconnection may be accomplished by any suitable detachable fastening means.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A random number generator, comprising:

a bottle having a main body, a bottom wall, and a neck formed integrally with said main body;

a predetermined plurality of numbered balls being loosely received within said main body so that said balls may be randomly scrambled when the bottle is shaken or inverted;

a flexible boot member of elongate, cylindrical configuration when in a position of repose;

said flexible boot member having a lowermost end that grippingly engages said neck when said flexible boot member is in a maximum-ball-retaining configuration;

said lowermost end of said flexible boot member grippingly engaging said neck and said main body when said boot member is displaced toward said bottom wall of said main body to reduce the ball-retaining capacity of said boot member;

said flexible boot member being formed of a resilient material and said flexible boot member continuously conforming to the shape of said neck and main body as said flexible boot member is displaced along the extent of said bottle.

2. A random number generator, comprising:

a bottle having a main body and an elongate neck formed integrally with said main body;

a predetermined plurality of numbered balls being loosely received within said bottle so that said balls may be randomly scrambled when the bottle is shaken or inverted;

a rigid boot member having a lowermost end conforming to the shape of said bottle main body and said rigid boot member having an uppermost end conforming to the shape of said neck;

said lowermost and uppermost ends of said rigid boot member slidably receiving the bottle main body and neck, respectively;

said boot member having a first, lowermost position where the uppermost end thereof receives only one numbered ball when said bottle is inverted;

said boot member having a second, uppermost position where the uppermost end thereof receives at least six numbered balls therewithin when the bottle is inverted; and said boot member having a plurality of differing positions of adjustment between said lowermost and uppermost positions so that said uppermost end accommodates differing numbers of numbered balls therewithin when said bottle is inverted.

* * * * *